US007293927B2

(12) United States Patent
Goldberg

(10) Patent No.: US 7,293,927 B2
(45) Date of Patent: Nov. 13, 2007

(54) CARABINER WRITING INSTRUMENT

(75) Inventor: Edward Goldberg, Teaneck, NJ (US)

(73) Assignee: Forever Green Holdings, LLC, Woodbridge, NJ (US)

( * ) Notice: Subject to any disclaimer, the term of this patent is extended or adjusted under 35 U.S.C. 154(b) by 0 days.

(21) Appl. No.: 11/253,937

(22) Filed: Oct. 19, 2005

(65) Prior Publication Data

US 2006/0045606 A1 Mar. 2, 2006

Related U.S. Application Data

(63) Continuation of application No. 10/459,317, filed on Jun. 11, 2003, now Pat. No. 6,979,143, which is a continuation-in-part of application No. 29/180,486, filed on Apr. 24, 2003, now Pat. No. Des. 501,878, and a continuation-in-part of application No. 29/179,764, filed on Apr. 15, 2003, now Pat. No. Des. 504,149, and a continuation-in-part of application No. 29/179,838, filed on Apr. 15, 2003, now Pat. No. Des. 503,739, and a continuation-in-part of application No. 29/179,766, filed on Apr. 15, 2003, now Pat. No. Des. 503,427, and a continuation-in-part of application No. 29/179,839, filed on Apr. 15, 2003, now Pat. No. Des. 502,505, and a continuation-in-part of application No. 29/179,765, filed on Apr. 15, 2003, now Pat. No. Des. 502,504.

(51) Int. Cl.
*B43K 23/02* (2006.01)
*B43K 29/00* (2006.01)
*B43K 25/00* (2006.01)

(52) U.S. Cl. ..... 401/131; 401/195; 24/11 R

(58) Field of Classification Search ..... 401/104, 401/105, 106, 131, 195; 24/11 HC, 10 R, 24/11 R, 11 FE, 11 M; D19/36, 54
See application file for complete search history.

(56) References Cited

U.S. PATENT DOCUMENTS

| | | | | |
|---|---|---|---|---|
| 1,344,897 | A * | 6/1920 | Johnson | 401/244 |
| 1,397,818 | A | 11/1921 | Moore | |
| 1,557,267 | A | 10/1925 | Mostkoff | |
| 2,174,834 | A | 10/1939 | Purviance | |
| 2,293,430 | A * | 8/1942 | Forrest | 24/11 M |
| 2,512,031 | A | 6/1950 | Marcoux | |
| 2,541,669 | A * | 2/1951 | Rosa | 24/11 M |
| 2,928,373 | A * | 3/1960 | Esterow | 401/105 |
| 3,041,693 | A | 7/1962 | Simon, Jr. et al. | |

(Continued)

OTHER PUBLICATIONS

Catalog page "Fiskars hip clip".

(Continued)

*Primary Examiner*—David J. Walczak

(74) *Attorney, Agent, or Firm*—Michael R. Gilman; Kaplan Gilman Gibson & Dernier LLP

(57) ABSTRACT

A carabiner-type attachment for writing instruments in which the carabiner-type attachment device is attached to the side of said writing instrument or the cap therefor. The attachment device is preferably in the form of a carabiner in which at least a portion of the carabiner body is integral with a pen or pen cap. In alternative embodiments the attachment device is removable from said writing instrument or the cap of the writing instrument.

23 Claims, 12 Drawing Sheets

U.S. PATENT DOCUMENTS

| | | | |
|---|---|---|---|
| 4,516,869 | A | 5/1985 | Corpataux |
| 4,608,733 | A | 9/1986 | Eylers |
| RE32,656 | E | 4/1988 | Bellavance |
| 4,765,767 | A | 8/1988 | Marynissen et al. |
| 5,270,909 | A | 12/1993 | Weiss et al. |
| 5,463,798 | A | 11/1995 | Wurzer |
| 6,223,372 | B1 | 5/2001 | Barber |
| D449,857 | S | 10/2001 | Rosenbaum |

OTHER PUBLICATIONS

New Dimensions Online printout from www.newdimensions1.com of Carabiner Pens, dated Mar. 12, 2003.

* cited by examiner

CARABINER WRITING INSTRUMENT

This application is a continuation of 10/459,317, filed Jun. 11, 2003 now U.S. Pat. No. 6,979,143, which is a continuation-in-part of and incorporates by reference the entirety of each of the following U.S. Design Pat. applications: (1) 29/179,764 filed Apr. 15, 2003, now U.S. Design Pat. No. D504,149; (2) 29/179,838 filed Apr. 15, 2003, now U.S. Design Pat. No. D503,739; (3) 29/179,766 filed Apr. 15, 2003, now U.S. Design Pat. No. D503,427; (4) 29/179,839 filed Apr. 15, 2003, now U.S. Design Pat. No. D502,505; (5) 29/179,765 filed Apr. 15, 2003, now U.S. Design Pat. No. D502,504; and (6) 29/180,486 filed Apr. 24, 2003, now U.S. Design Pat. No. D501,878.

FIELD OF THE INVENTION

The invention relates generally to carabiner-type attachment devices adapted to use on writing instruments such as pens and caps therefor.

BACKGROUND OF THE INVENTION

Carabiners have long been in use for providing a means for attaching articles to each other. Such devices have numerous applications, such as for example enabling multiple articles to be secured to a backpack, purse, handbag, key chain or the like. U.S. Pat. No. 5,005,266 discloses a typical carabiner-type attachment device.

Writing instruments are ubiquitous and in most occupations are indispensable. As such it is useful to be able to attach a writing instrument to a garment, clipboard or the like so as not to misplace the instrument. Heretofore writing instruments have been equipped with resilient clips for attachment purposes. These clips are not suitable for all applications, however. For instance, such clips are not well suited for attaching a writing instrument to a strap, belt loop or the like.

U.S. Design Pat. No. 449,857 discloses an ornamental design for a combination pen and carabiner in which the carabiner is attached by a ring to said pen wherein the pen, when in an attached mode depending from said carabiner, can move freely in relation to the carabiner. Such a design is disadvantageous since the depending pen can swing wildly from the carabiner causing possible injury. Likewise, Fiskars has recently marketed a highlighting pen having a carabiner-like attachment co-molded to the top end of a pen or top end of a pen cap. This device has the similar disadvantage of being subject to swinging freely from an attached position. Moreover, in the embodiment wherein the carabiner is co-molded to the pen cap, the likelihood of the pen unintentionally separating and detaching from the pen cap, when the pen cap is attached by the co-molded carabiner to a strap or the like, is increased when unintended force is applied, i.e., when the depending pen swings from its point of attachment centrifugal force is applied in the precise direction employed to remove said cap for purposes of intended use.

Therefore it would be a considerable advantage to be able to attach the writing instrument to other articles such as but not limited to luggage, belt loops, towel racks, wall hooks, utility belts, backpacks and the like in a manner that is safe and is less likely to result in separation of the writing instrument from the cap employed therewith.

SUMMARY OF THE INVENTION

The present invention provides a carabiner-type attachment for writing instruments in which the carabiner-type attachment device is attached to the side of said writing instrument or the cap therefor. The attachment device is preferably in the form of a carabiner in which at least a portion of the carabiner body is integral with a pen or pen cap.

OBJECTS OF THE INVENTION

It is an object of the present invention to provide a carabiner-type attachment for a writing instrument.

It is another object of the present invention to provide a carabiner-type attachment for a cap for a writing instrument.

It is another object of the present invention to provide a carabiner-type attachment for a writing instrument wherein the carabiner-type attachment device is integral with the writing instrument.

It is another object of the present invention to provide a carabiner-type attachment for a writing instrument wherein the carabiner-type attachment device is detachably connected to the writing instrument.

It is another object of the present invention to provide a carabiner-type attachment for a writing instrument wherein the carabiner-type attachment device is integral with a cap for the writing instrument.

It is another object of the present invention to provide a carabiner-type attachment for a writing instrument wherein the carabiner-type attachment device is detachably connected to a cap for the writing instrument.

It is a further object of the present invention to provide a carabiner-type attachment for a writing instrument wherein the carabiner-type attachment permits safe and secure attachment of the writing instrument to luggage, belt loops, towel racks, wall hooks, utility belts, backpacks and the like.

DETAILED DESCRIPTION OF THE PREFERRED EMBODIMENT

In the following description, for purposes of explanation, specific numbers, materials and configurations are set forth in order to provide a thorough understanding of the invention. It will be apparent, however, to one having ordinary skill in the art that the invention may be practiced without these specific details. In some instances, well-known features may be omitted or simplified so as not to obscure the present invention. Furthermore, reference in the specification to "one embodiment" or "an embodiment" means that a particular feature, structure or characteristic described in connection with the embodiment is included in at least one embodiment of the invention. The appearances of the phrase "in one embodiment" in various places in the specification are not necessarily all referring to the same embodiment.

Figure 1:
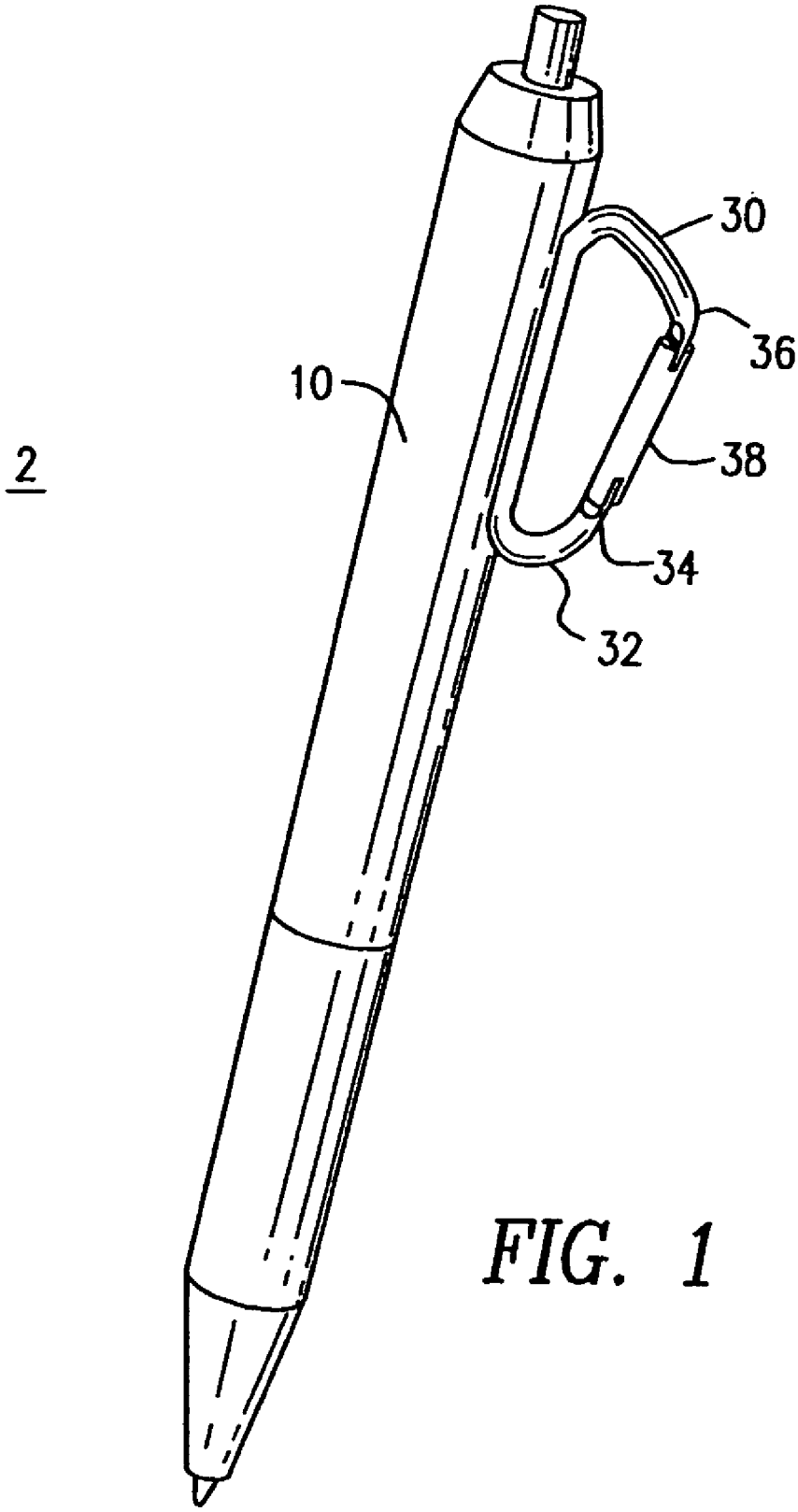
FIG. 1 is a perspective view of a preferred embodiment of the present invention.
Figure 1A:
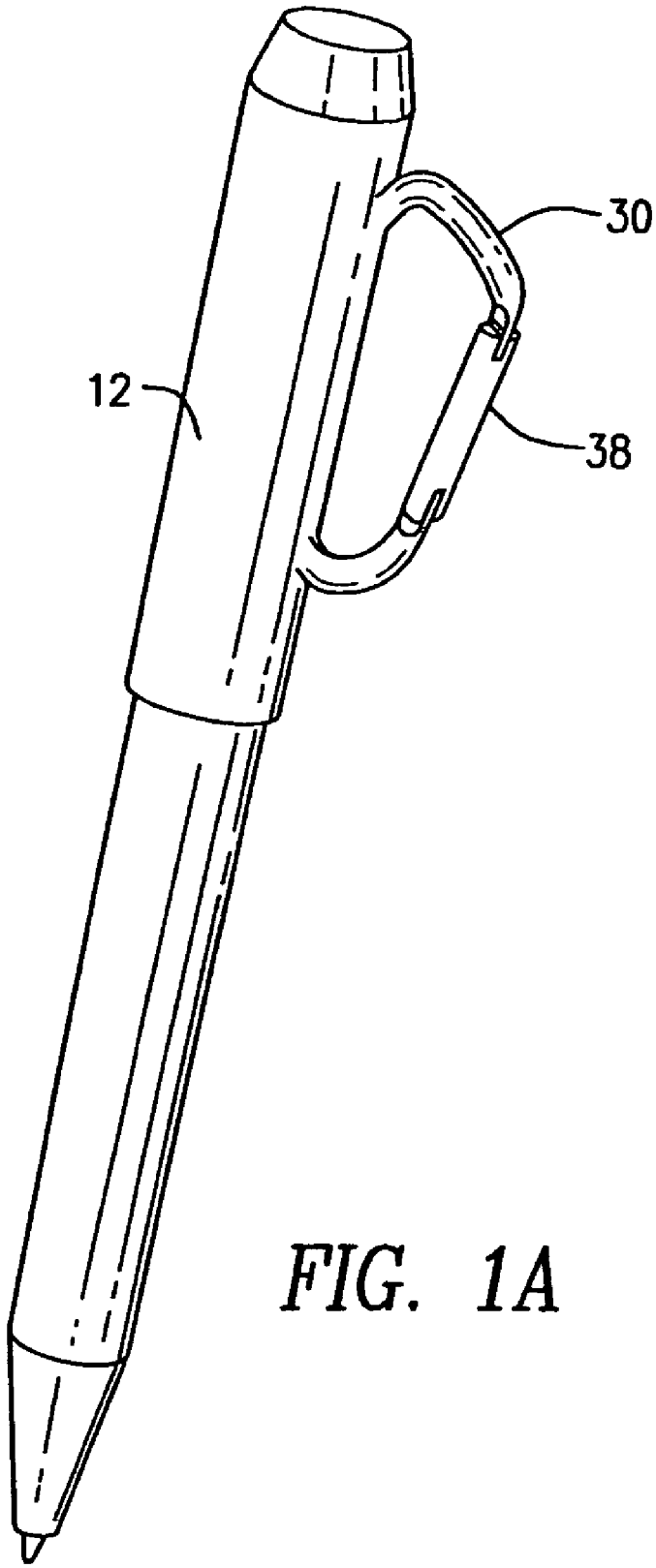
FIG. 1A is a perspective view of a preferred embodiment of the present invention.

Now referring to FIGS. 1 and 1A a preferred embodiment of the device 2 comprises essentially a writing instrument 10 and at least one attachment device 30.

Writing instrument 10 may comprise any suitable writing instrument with or without a cap 12 including but not limited to a pen, pencil, marker or the like as are well known in the art.

Attachment device 30 comprises at least one body member 32 and one openable gate member 38. Now referring to FIG. 1 in a preferred embodiment body member 32 comprises at least a first elongated section comprising a first end 34 and a second end 36 and is typically fabricated of any material suitable for attachment devices such as but not limited to bare or coated metal, wood, rubber, plastic, combinations thereof or any other suitable material as is well known in the art. In a preferred embodiment gate member 38 comprises an elongated member pivotably attached at one end to one end 34 or 36 of said body member 32. The other end of gate member 38 contacts or is in close proximity to the other end 34 or 36 of said body member 32 when said gate 38 is in a closed position. In a preferred embodiment gate member 38 is inwardly openable. Gate member 38 is fabricated of any suitable material as recited above for body member 32, but does not necessarily need to be of the same material as that of body member 32. Gate member 38 may be separately molded and attached to body member 32 by means of a pin or other means well known in the art. In a preferred embodiment body member 32 is curvilinear. In a most preferred embodiment attachment device 30 is formed in the shape of a carabiner but as seen in FIGS. 6-9 other shapes are contemplated by the present invention.

Now referring to FIG. 1A, in a preferred embodiment writing instrument further comprises a cap 12. Attachment device 30 is integrally formed with said cap 12. Now referring to FIG. 1B attachment device 30 is integral with said writing instrument 10. Such integral embodiment may be achieved by any means known in the art appropriate for the material employed in construction of the attachment means, such as for example molding where said attachment means is fabricated of plastic.

Figure 1B:
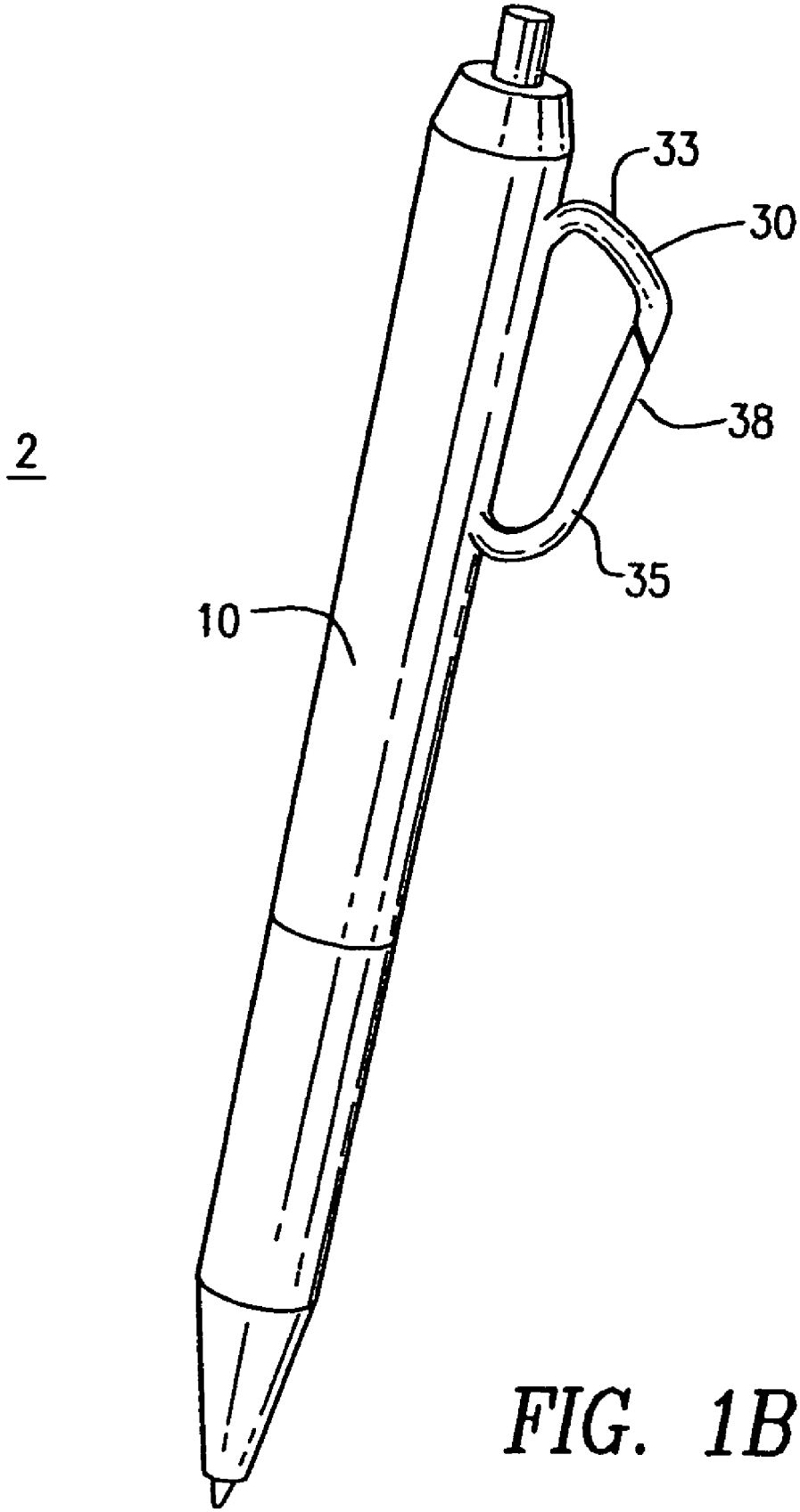
FIG. 1B is a perspective view of a preferred embodiment of the invention.

Now referring to FIG. 1B in one embodiment body member 32 is integral with said writing instrument 10 and comprises at least a first elongated section 33 and second elongated section 35. Gate member 38 comprises an elongated member integrally extending from second elongated member 35. Preferably the integral body 32 and gate member 38 are fabricated of a resilient material such as but not limited to rubber, plastic, or any other suitable resilient material as is well known in the art. A first end of gate member 38 contacts or is in close proximity to an end of said elongated section 33 when said gate 38 is in a closed position. In this embodiment a resilient attachment device is formed without a pivoting hinge. The gate member 38 simply deforms when pressure is applied and resiliently returns to its original position when pressure is released. In a most preferred embodiment attachment device 30 is formed in the shape of a carabiner but other shapes are contemplated by the present invention.

Figure 1C:
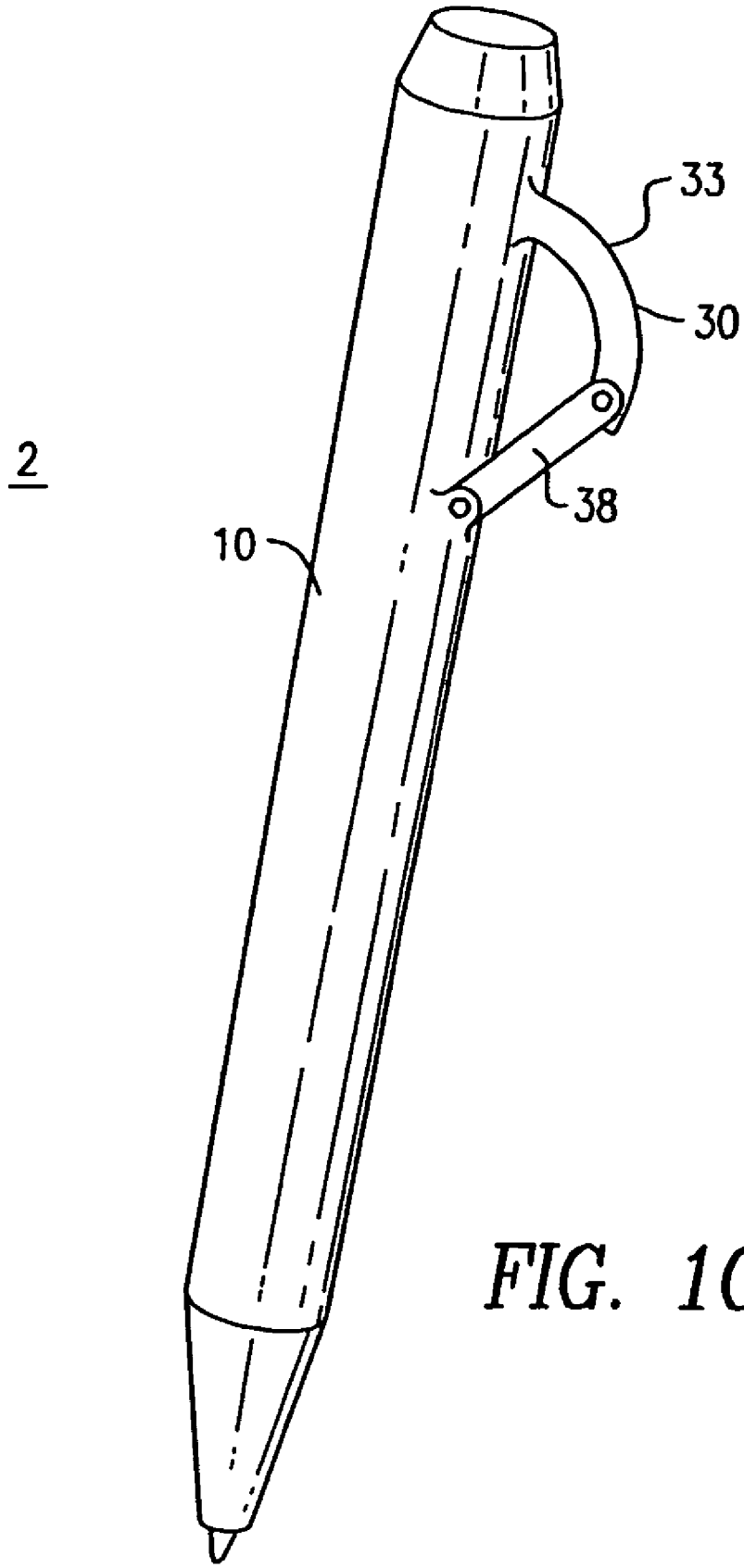
FIG. 1C is a perspective view of a most preferred embodiment of the invention.

Now referring to FIG. 1C in a most preferred embodiment attachment device 30 comprises one elongated section 33 extending from said writing instrument 10 or cap 12 (not shown). Gate member 38 is pivotably attached to said writing instrument 10 or cap 12.

Figure 2:
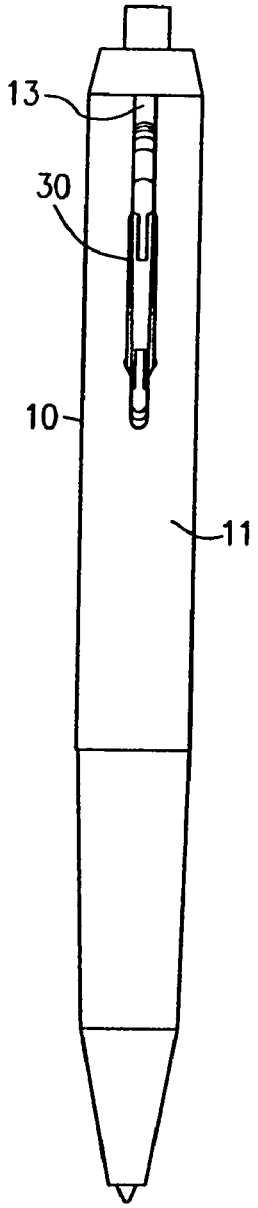
FIG. 2 is a side view of a preferred embodiment of the invention.
Figure 3:
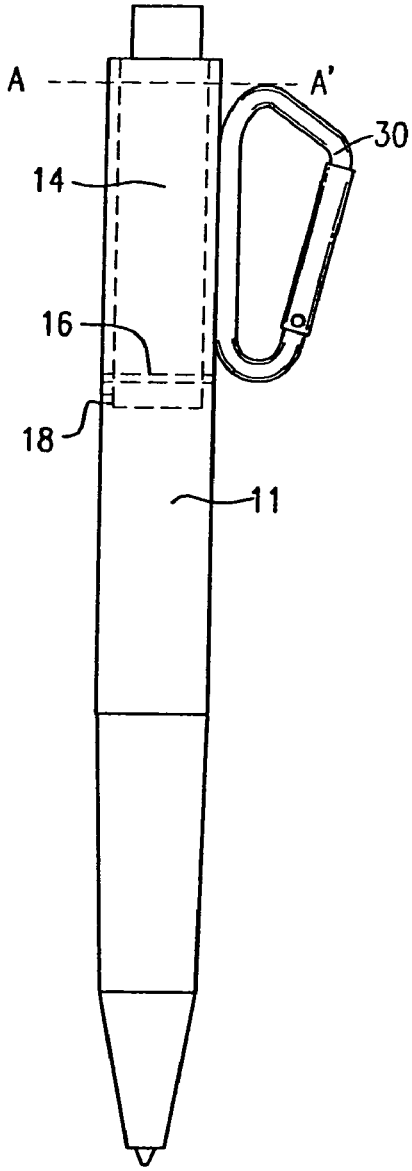
FIG. 3 is a front view of the embodiment of the invention as shown in FIG. 2.
Figure 3A:
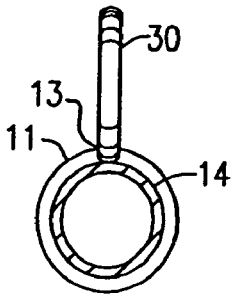
FIG. 3A is a top sectional view of the embodiment of the invention as shown in FIG. 3 through the line A-A'.
Figure 3B:
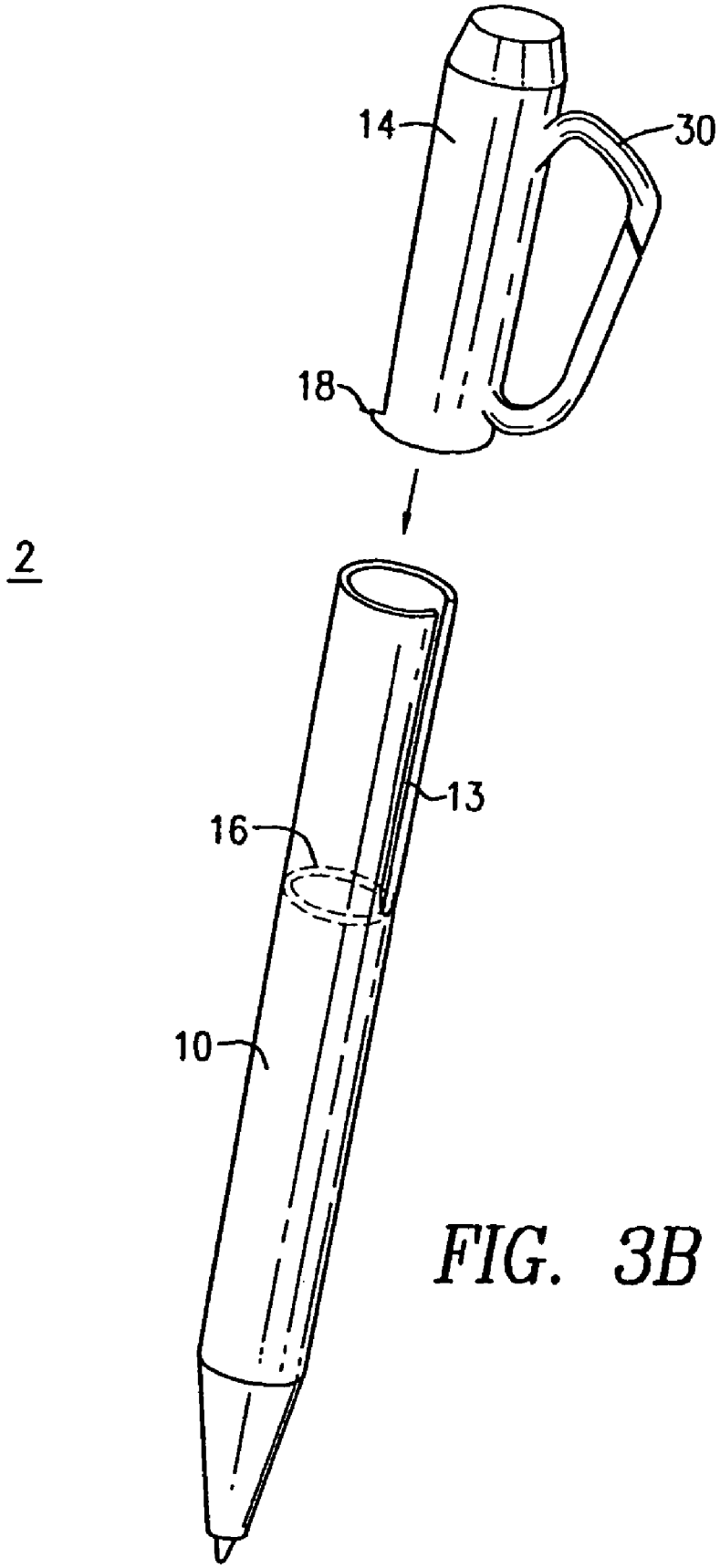
FIG. 3B is an exploded perspective view of the embodiment of the invention as shown in FIGS. 2 and 3.

Now referring to FIGS. 2-3B in an alternate preferred embodiment device 2 comprises a writing instrument 10 comprising an outer sleeve 11 having formed therein a vertical slot 13, and an inner sleeve 14. Now referring to FIG. 3A inner sleeve 14 comprises a peripheral profile that permits it to be engaged within outer sleeve 11. Inner sleeve 14 further comprises attachment device 30 extending therefrom. Inner sleeve 14 is fabricated of any material suitable for use in a writing instrument such as but not limited to bare or coated metal, wood, rubber, plastic, combinations thereof or any other suitable material as is well known in the art. Now referring to FIG. 3A preferably sleeves 11 and 14 are substantially circular in cross-section. Now referring to FIGS. 3A and 3B slot 13 accommodates attachment device 30 when inner sleeve 14 is inserted within outer sleeve 11. Inner sleeve 14 is secured within said outer sleeve 11 by any means known to one having ordinary skill in the art such as but not limited to adhesive or friction engagement. Alternatively a cap may be employed over the end of said writing instrument 10 after insertion of inner sleeve 14. In a most preferred embodiment outer sleeve 11 further comprises an interior lip 16 and inner sleeve 14 further comprises an exterior tab 18 disposed proximal its lower edge to securely engage said inner sleeve 14 within said outer sleeve 11. In this embodiment inner sleeve is preferably formed of a resilient material to enable the engagement of tab 18 under lip 16.

Figure 4:
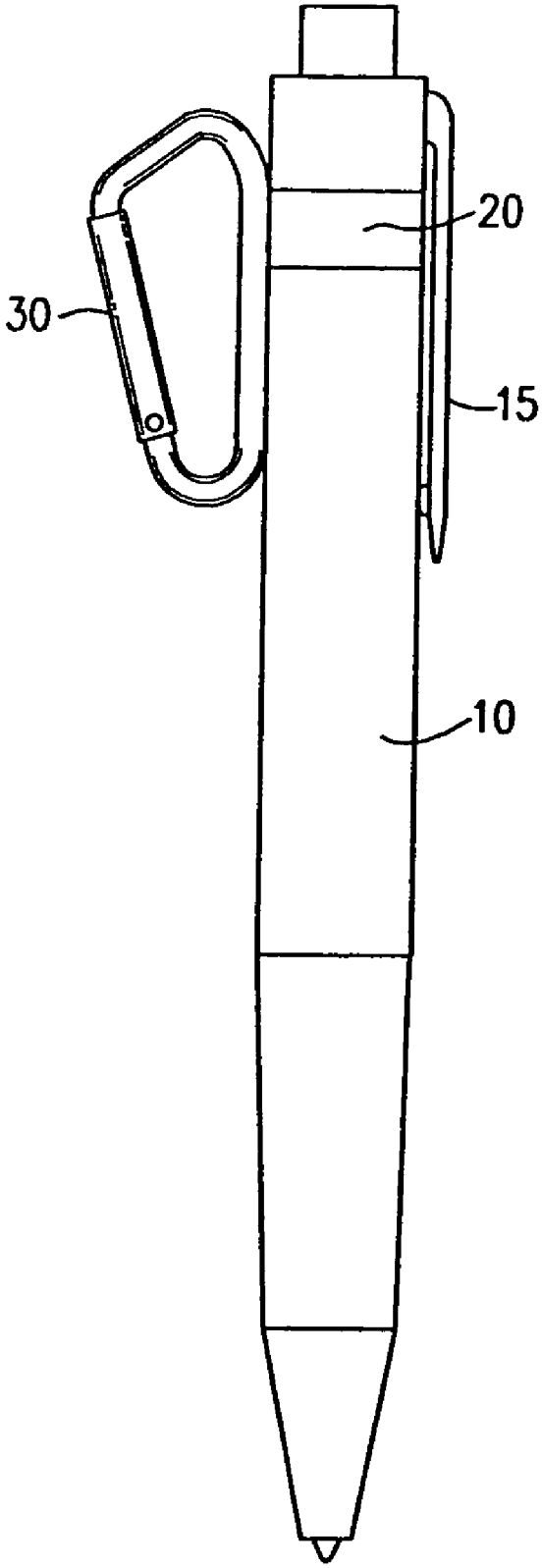
FIG. 4 is a front view of a preferred embodiment of the invention.
Figure 4A:
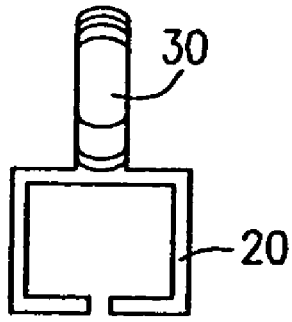
FIG. 4A is a top view of a preferred embodiment of the band element of FIG. 4.

Now referring to FIGS. 4 and 4A, in an alternate embodiment the means for attaching said attachment device 30 to said writing instrument 10 or cap 12 is a band 20 from which attachment device 30 extends. Band 20 comprises any material suitable for use in conjunction with a writing instrument 10 such as but not limited to bare or coated metal, wood, rubber, plastic, combinations thereof or any other suitable material as is well known in the art. In a preferred embodiment band 20 is co-molded with said attachment device 30. In a most preferred embodiment band 20 comprises a cross-section that is substantially similar in shape to the periphery of said writing instrument 10. Now referring to FIG. 4 writing instrument 10 or cap 12 may further comprise a clip 15.

Figure 5:
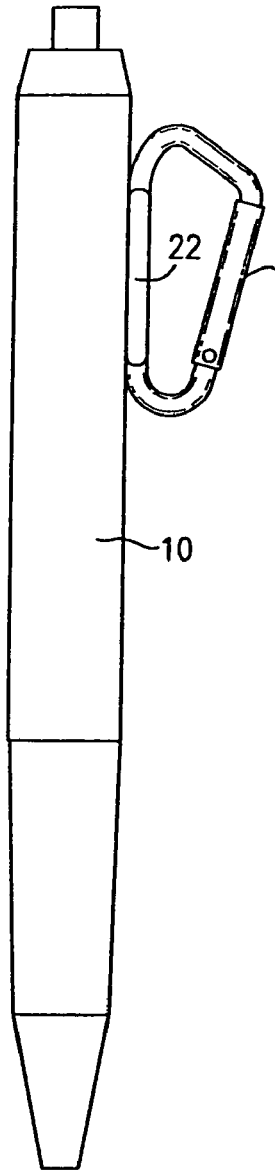
FIG. 5 is a front view of a further embodiment of the present invention.
Figure 5A:
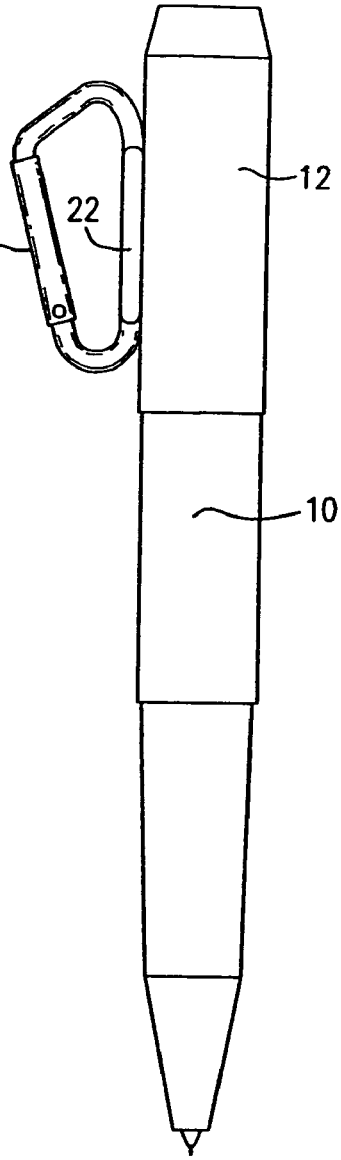
FIG. 5A is a back view of an alternate embodiment of the present invention as shown in FIG. 5.
Figure 5B:
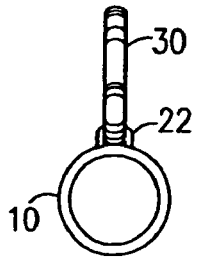
FIG. 5B is a top view of the preferred embodiment of FIG. 5A.
Figure 5C:
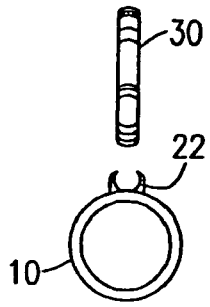
FIG. 5C is a top view of a preferred embodiment of the invention according to FIG. 5A, wherein the carabiner-type attachment device is disengaged from the writing instrument.
Figure 6:
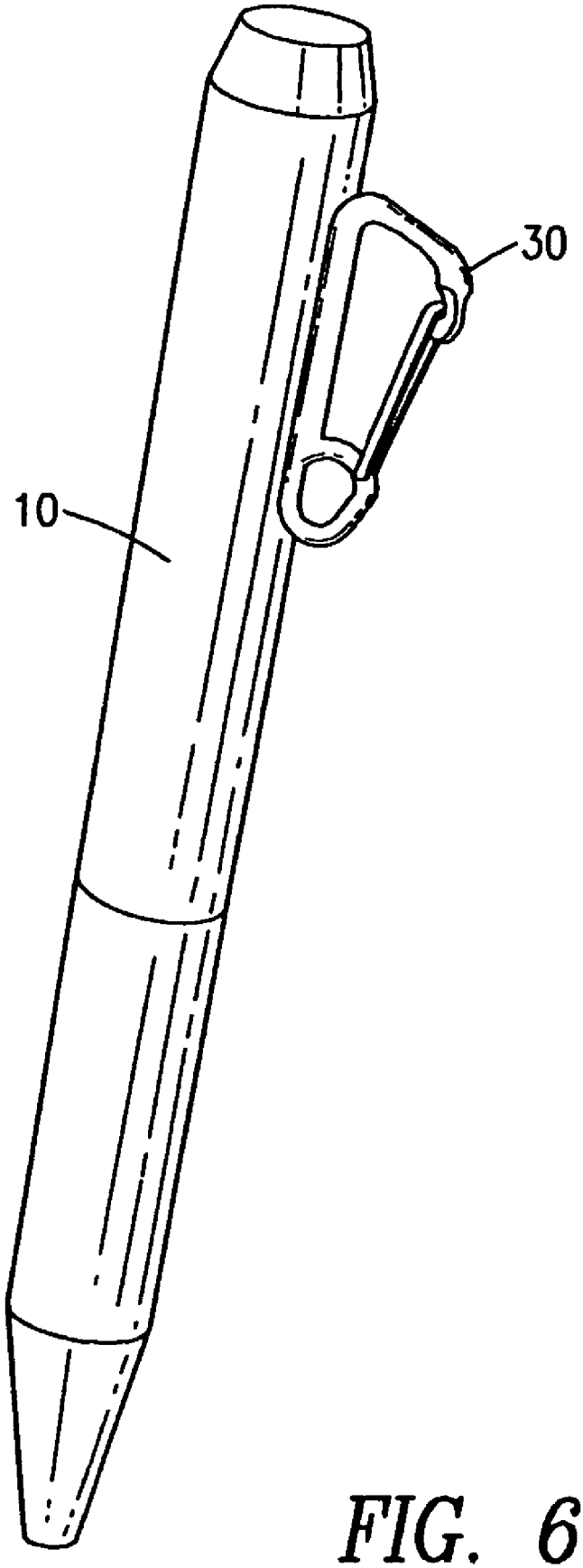
FIG. 6 is a perspective view of a preferred embodiment of the invention.
Figure 7:
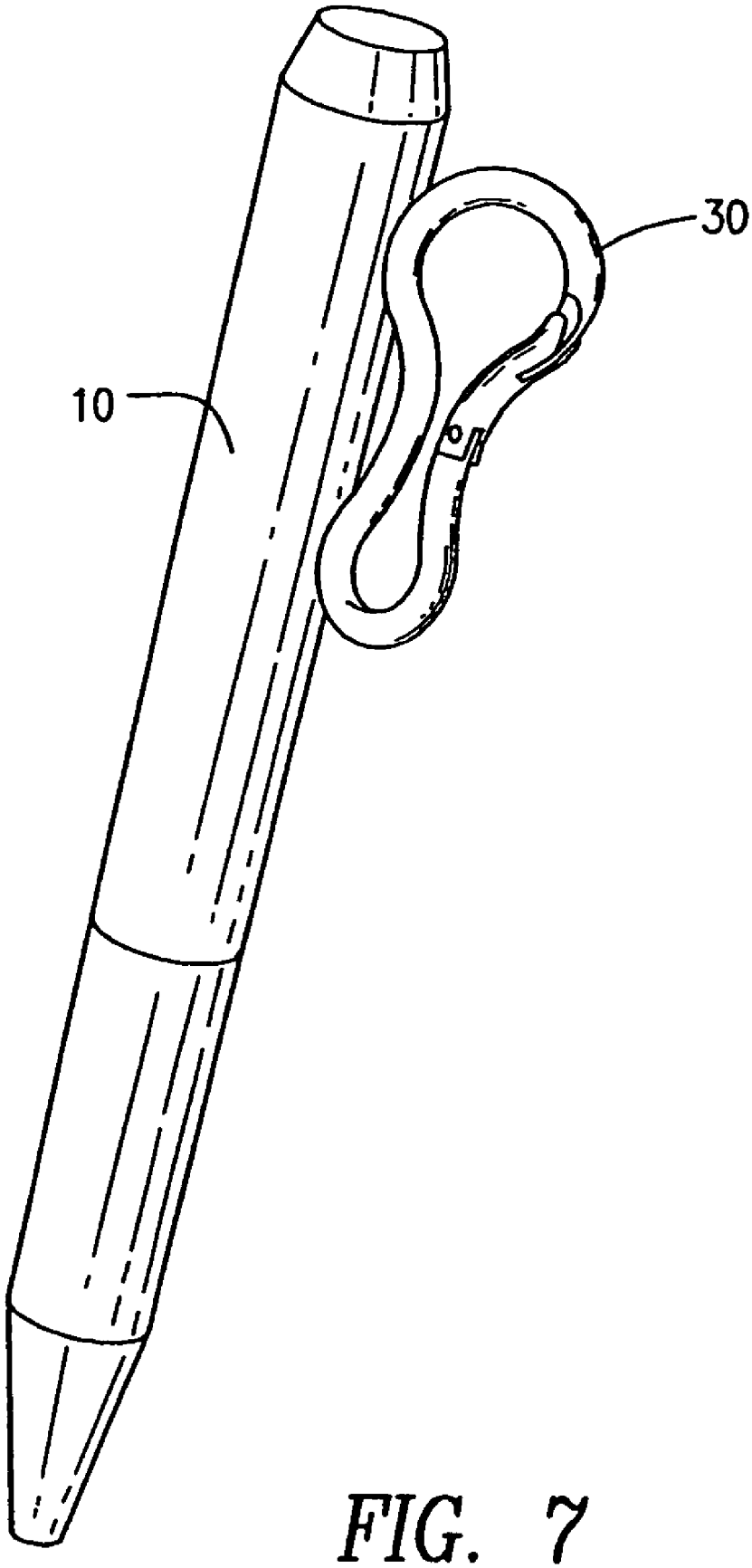
FIG. 7 is a perspective view of a preferred embodiment of the invention.
Figure 8:
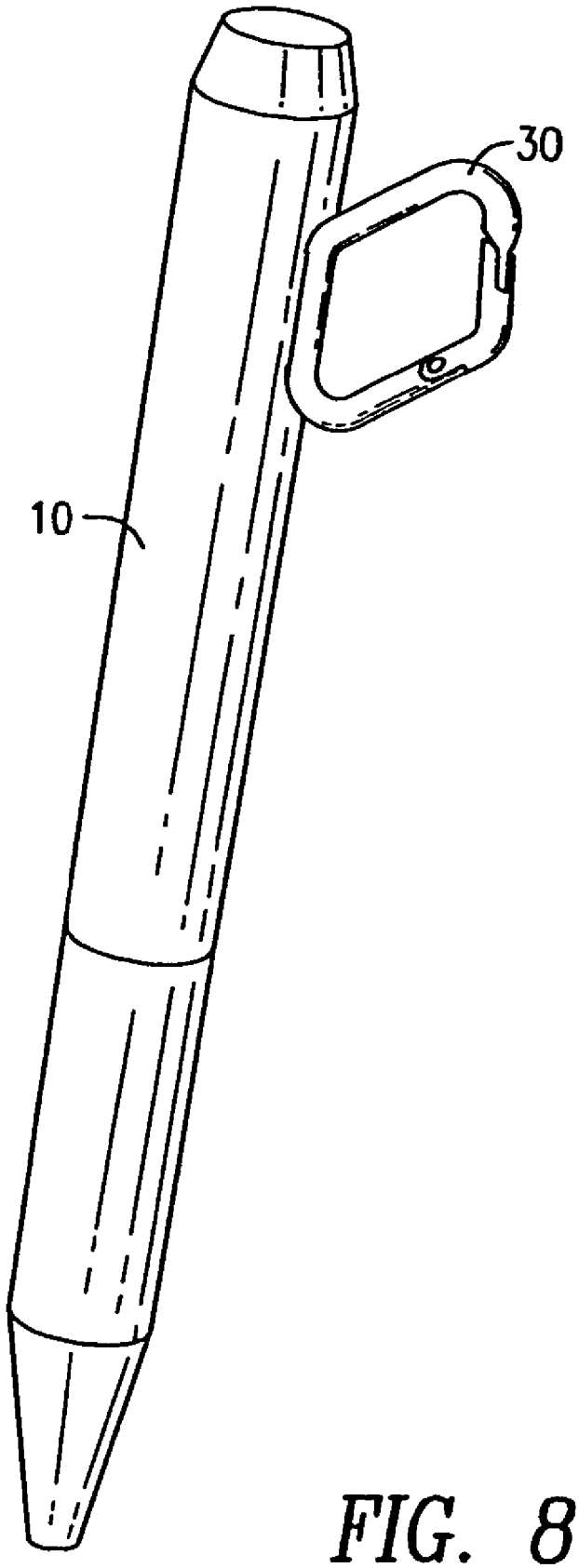
FIG. 8 is a perspective view of a preferred embodiment of the invention.
Figure 9:
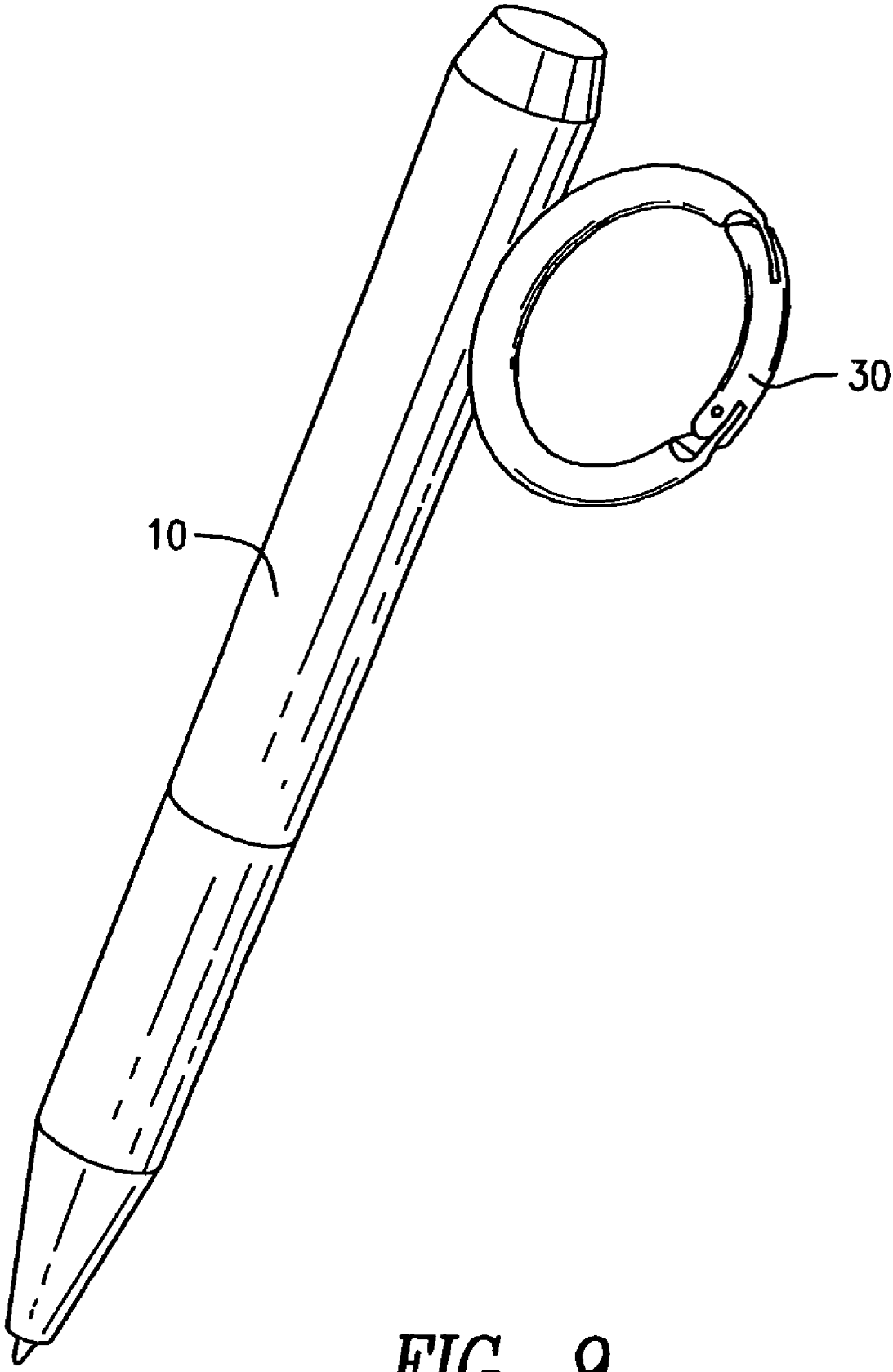
FIG. 9 is a perspective view of a preferred embodiment of the invention.

Now referring to FIGS. 5-5C, in an alternate embodiment the means for attaching said attachment device 30 to said writing instrument 10 is a clip 22 to which attachment device 30 is attached. Clip 22 comprises any material suitable for use in conjunction with a writing instrument such as but not limited to bare or coated metal, wood, rubber, plastic, combinations thereof or any other suitable material as is well known in the art. Clip 22 is attached to said writing instrument 10 or cap 12 by any means known to one having ordinary skill in the art including but not limited to clipping, adhesive, molding or the like. In a preferred embodiment clip 22 comprises a resilient material that permits attachment device 30 to be snapped into place. In other embodiments attachment device 30 may be slidably engaged to clip 22. Now referring to FIG. 5C, in a most preferred embodiment attachment device 30 is removably attached to clip 22.

Now referring to FIGS. 6-9 attachment device 30 may comprise any shape.

While the preferred embodiments have been described and illustrated it will be understood that changes in details and obvious undisclosed variations might be made without departing from the spirit and principle of the invention and therefore the scope of the invention is not to be construed as limited to the preferred embodiment.

What is claimed is:

1. A writing instrument comprising at least two elongate members, at least one of which elongate members extends from a portion of a side of an outside surface of said writing instrument, each of said elongate members comprising a first end and a second end, said first ends located exterior of said writing instrument and extending from said outside surface of said writing instrument and said second ends proximal to each other, at least one of said members having a gate member extending therefrom from a first end of said gate member, wherein a second end of said gate member is in substantial contact with said second end of said other elongate member at a terminal end thereof when said gate member is in a closed position.

2. The writing instrument according to claim 1, wherein said gate member is pivotally extending from said at least one of said members.

3. The writing instrument according to claim 1, wherein at least one of said elongate members is integrally extending from said outside surface of said writing instrument.

4. The writing instrument according to claim 1, wherein at least one of said elongate members comprising a resilient material.

5. The writing instrument according to claim 1, wherein said elongate members are arranged in such a manner as to have the appearance of a carabiner.

6. The writing instrument according to claim 1, wherein said side of said writing instrument comprises a side of a cylindrical body member.

7. A writing instrument, comprising:

a substantially tubular body member;

at least one attachment device comprising a first elongate member, a second elongate member, and a selectively openable gate member, said first elongate member located exterior of said writing instrument and extending from a portion of a side of an outside surface of said substantially tubular body member substantially towards said second elongate member and ending proximate a portion of said selectively openable gate member, said second elongate member located exterior of said writing instrument and extending from another portion of said outside surface of said substantially tubular member, in a direction substantially towards said first elongate member, and said gate member selectively, openably extending between terminal ends of said elongate members.

8. The writing instrument according to claim 7, wherein said gate member is resiliently extending from said at least one of said members.

9. The writing instrument according to claim 7, wherein said gate member is pivotally extending from said at least one of said members.

10. The writing instrument according to claim 7, wherein said outside surface of said writing instrument is an outside surface of a cap for said writing instrument.

11. The writing instrument according to claim 7, further comprising a writing end and another end located opposite said writing end along said substantially tubular body member, said at least one attachment device located proximate said another end.

12. The writing instrument according to claim 11, further comprising a cap for receipt over said another end of said substantially tubular body member.

13. The writing instrument according to claim 7, wherein at least one of said elongate members is integrally extending from said outside surface of said writing instrument.

14. The writing instrument according to claim 7, wherein said substantially tubular body member is cylindrical.

15. A writing instrument comprising:

a body member having a writing end and an opposite end, said ends connected by a body comprising an outside surface and a side portion extending along a portion of said outside surface;

at least one attachment device comprising at least two elongate members, each elongate member comprising a first end and a second terminal end, said first end of one of said at least two elongate members located exterior of said writing instrument and extending from said side portion of said body member, said first end of the other one of said at least two elongate members located exterior of said writing instrument and extending from said opposite end;

said second terminal ends of said at least two elongate members extending substantially towards one another; and a selectively openable gate member operable in-between said second terminal ends of said at least two elongate members.

16. The writing instrument according to claim 15, wherein said gate member is resiliently extending from said at least one of said members.

17. The writing instrument according to claim 15, wherein said gate member is pivotally extending from said at least one of said members.

18. The writing instrument according to claim 15, wherein said outside surface of said writing instrument is an outside surface of a cap for said writing instrument.

19. The writing instrument according to claim 15, wherein said at least one of said elongate members is integrally extending from said side portion of said body member.

20. The writing instrument according to claim 15, wherein said at least another of said elongate members is integrally extending from said opposite end of said body member.

21. The writing instrument according to claim 1, wherein said gate member is resiliently extending from said at least one of said members.

22. The writing instrument according to claim 1, wherein said outside surface of said writing instrument is an outside surface of a cap for said writing instrument.

23. A writing instrument comprising a writing end and an opposite end, a first elongate member extends from a portion of a side of an outside surface of said writing instrument in a direction toward said opposite end of said writing instrument and a second elongate member extends from another portion of said outside surface of said writing instrument toward said first elongate member and said writing end of said writing instrument, wherein a distance between ends of said first and second elongate members define a gap therebetween, and a gate member, extending from said first elongate member toward said opposite end of said writing instrument and said second elongate member, is selectively movable between an open and closed position within said gap.

* * * * *